United States Patent [19]

Honkura et al.

[11] Patent Number: 4,975,131

[45] Date of Patent: Dec. 4, 1990

[54] HIGH STRENGTH HOT WORKED STAINLESS STEEL

[75] Inventors: Yoshinobu Honkura, Kounan; Yoshihiro Nakashima, Tokai; Toru Matsuo, Tokai; Kouji Murata, Tokai, all of Japan

[73] Assignee: Aichi Steel Works, Ltd., Takai, Japan

[21] Appl. No.: 338,420

[22] Filed: Apr. 14, 1989

Related U.S. Application Data

[63] Continuation of Ser. No. 716,442, Mar. 26, 1985, abandoned.

[30] Foreign Application Priority Data

Mar. 30, 1984 [JP] Japan ..... 59-64845

[51] Int. Cl.[5] ..... C22C 38/48

[52] U.S. Cl. ..... 148/327; 148/325

[58] Field of Search ..... 75/128 A, 128 N, 128 G, 75/128 P; 148/325, 327; 420/56, 59, 66, 84, 87, 48, 54

[56] References Cited

U.S. PATENT DOCUMENTS 4,584,031 4/1986 Grützner ..... 148/327

*Primary Examiner*—Deborah Yee

*Attorney, Agent, or Firm*—Berman, Aisenberg & Platt

[57] ABSTRACT

As for high strength stainless steels and method for manufacturing the high strength stainless steels, the strength of the stainless steels are enhanced by adding an appropriate amount of both nitrogen and niobium to austenitic stainless steels, inhibiting boron, an impure element, and decreasing the carbon content. The strength of the stainless steels are further enhanced by such heat treatment as control rolling and low temperature solution heat treatment applied to the stainless steels after the control rolling.

22 Claims, 2 Drawing Sheets

HIGH STRENGTH HOT WORKED STAINLESS STEEL

RELATED APPLICATION

This is a continuation of Ser. No. 716,442, filed Mar. 26, 1985 now abandoned.

BACKGROUND OF THE INVENTION

1. Field of the Invention

This invention relates to austenitic stainless steels which are superior in hardness and corrosion resistance and employed in such plants as chemical, sea water and nuclear plants.

2. Description of the Prior Art

Austenitic stainless steels are widely employed in the construction of plants because of their superiority in corrosion resistance, heat resistance, workability, and mechanical properties. Typical austenitic stainless steels are such steels as SUS304, SUS316, SUS304L, SUS316L. As machines and building structures have become larger recently, the improvement in the strength of structural stainless steels has been desired. And, the steels, which are made of the above steels with addition of nitrogen and niobium, such as $SUS304N_1$, $SUS304N_2$, SUS304LN, SUS316N, and SUS316LN are well-known.

The strength of these steels after solution heat treatment, however, is not sufficient although the yield strength of SUS304LN and SUS316LN equals to or exceeds 25 kg/m$^2$ and $SUS304N_1$ and SUS316N possess yield strengths exceeding 28 kg/mm$^2$. The yield strength of SUS304N exceeds 35 kg/mm$^2$, which is a relatively high strength, but not always sufficient.

Various techniques have been studied in recent years to further improve the strength of these steels. And, cold-working and control rolling, for example, have been suggested for the purpose.

Cold-working, however, requires a reduction ratio exceeding 20% to produce a desired strength. For this reason, cold-working is employed only for sheet steels and wire rods.

Control rolling cannot provide sufficient strength for SUS316LN, 316N, 316L, 316, 304LN, $304N_1$, 304 and 304L, and causes $SUS304N_2$ to crack during hot-working. And this technique cannot provide sufficient corrosion resistance for $SUS304N_2$, either. Thus, control rolling has not been applied in practical use.

Further $SUS304N_1$, $SUS304N_2$ and SUS316N are inferior in intergranular corrosion resistance and stress corrosion cracking susceptibility resistance, and the corrosion resistance of these steels decreases sharply after welding.

BRIEF DESCRIPTION OF THE DRAWINGS

A better understanding of the prior art and of the present invention will be obtained by reference to the detailed description below and to the attached drawings, in which.

SUMMARY OF THE INVENTION

An object of this invention is therefore to overcome the above objections of conventional stainless steels. In order to improve the strength and corrosion resistance of stainless steels, an appropriate amount of both nitrogen and niobium are added to austenitic stainless steels, boron, an impure element, is inhibited and the carbon content is decreased. In addition, the strength of the steels is further enhanced by such heat treatment as control rolling and low temperature solution heat treatment applied to the steels after the control rolling.

Figure 1:
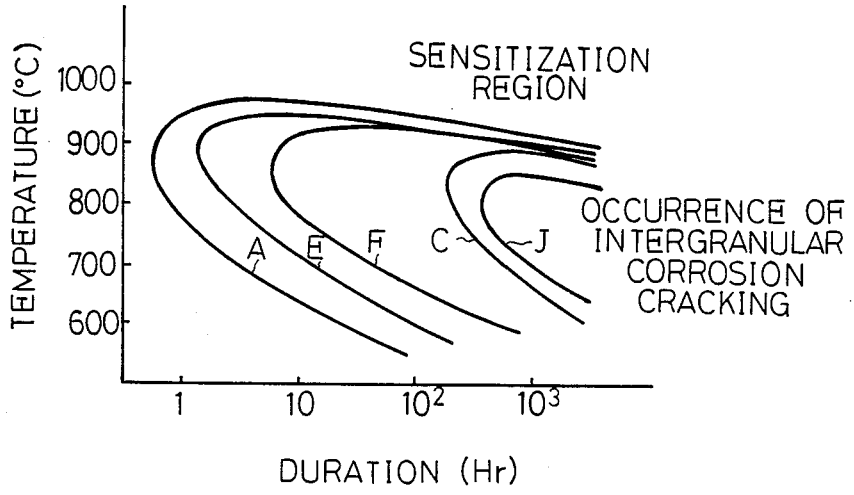
FIG. 1 is a diagram showing the relationship of temperatures of sensitization and the duration of sensitization which affect the intergranular corrosion resistance of sample steels.

As a result of research on the effects of carbon, nitrogen, niobium and boron, and rolling temperatures on the strength and corrosion resistance of austenitic stainless steels, it has been found, firstly, an intergranular corrosion resistance exceeding that of SUS304L (as illustrated in FIG. 1) can be obtained by adding both 0.15–0.28% nitrogen and 0.05–0.25% niobium and limiting carbon to not more than 0.03% and boron to not more than 20 ppm.

Secondly, although the strengthening effect of niobium is generally considered to be made by refining crystal grains and precipitation hardening by the precipitation of NbC, the strengthening effect of niobium occurs clearly in the steels containing 0.15–0.28% nitrogen even if carbon content is decreased to not more than 0.03%. It can be so considered that in low carbon content steels the effects of refining of crystal grains and precipitation hardening occur by the precipitation of NbN or Nb(C,N).

Figure 2:
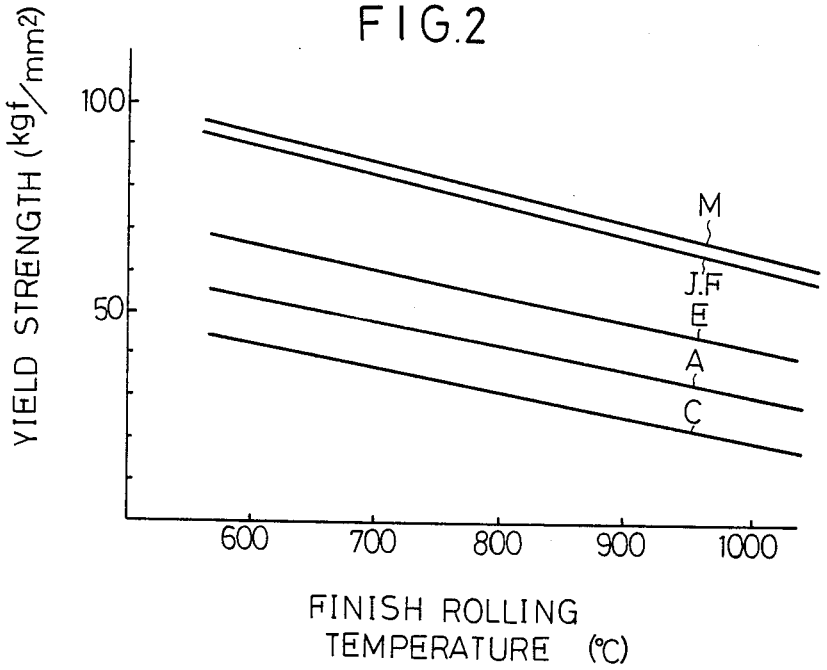
FIG. 2 is a diagram showing the influence of finish rolling temperatures on the strength of the sample steels.

Thirdly, when steels containing 0.15–0.28% nitrogen, 0.05–0.025% niobium, not more than 0.03% carbon, and not more than 20 ppm boron are control-rolled at finishing temperatures of 600°–1,000° C., the strengthening effect of niobium lasts even after the control rolling, and strength comparable to that of control-rolled $SUS304N_2$ is produced as illustrated in FIG. 2.

Figure 3:
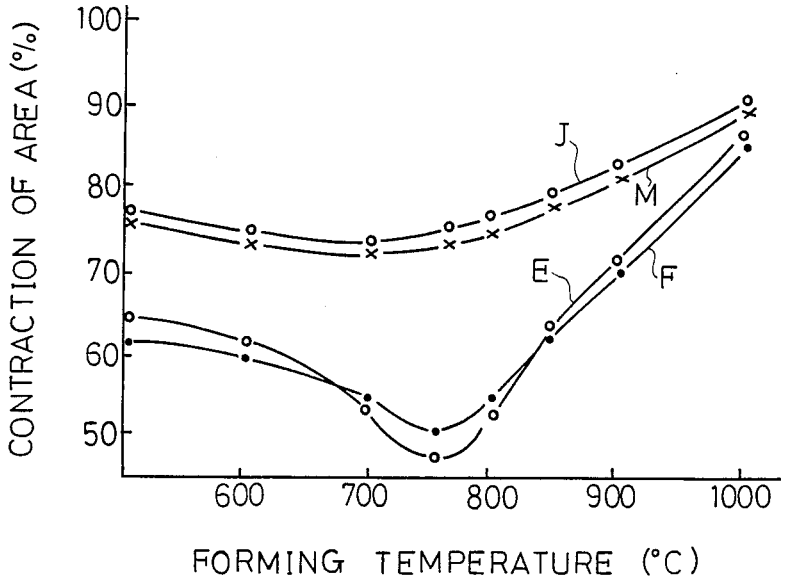
FIG. 3 is a diagram showing the influence of forming temperatures on the hot workability of the sample steels.
Figure 4:
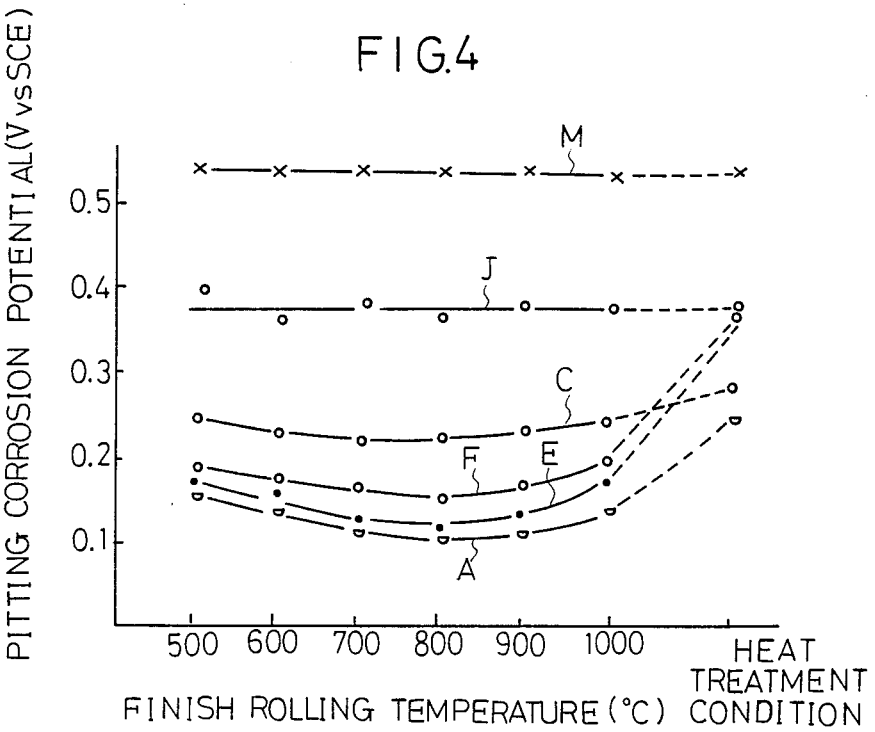
FIG. 4 is a diagram showing the influence of finish rolling temperatures on the corrosion resistance of the sample steels.

In addition, hot workability as illustrated in FIG. 3 increases sharply compared with SUS304N and $SUS304N_2$ at control rolling temperatures of 600°–1,000° C., whereby the occurrence of cracking by rolling is prevented. Further, the corrosion resistance comparable to steels to which solution heat treatment is provided (as illustrated in FIG. 4) can be obtained regardless of the structures of steels being recrystallized microstructures or unrecrystallized processed structures.

The high-strength stainless steels and the method for manufacturing the same of the present invention have been developed with the above findings. The steels of this invention possess a high yield strengths exceeding 35 kg/mm$^2$, and the strength can be further improved to more than 50 kg/mm$^2$ or 70 kg/mm$^2$ by control rolling.

The steels of this invention are superior in corrosion resistance, especially intergranular corrosion resistance and stress corrosion cracking susceptibility resistance. And, the pitting corrosion resistance and acid resistance of the steels of this invention are higher than those of SUS304, and the corrosion resistance of the steels of this invention does not decrease even after welding is applied. Moreover, these stainless steels possess good hot-workability, and they can be manufactured in the same process as employed in production of SUS304. Therefore, the stainless steels and the method for manufacturing the same of this invention are economical.

Molybdenum and copper are added to these steels as required to further improve their corrosion resistance. And a little amount of sulfur and/or selenium are added to improve the machinability of these steels.

The stainless steels of this invention are superior in strength and corrosion resistance and can be used appropriately for reinforcement members for chemical plants, sea water plants, nuclear plants and the like.

DETAILED DESCRIPTION OF THE INVENTION

The steels of this invention and the method for manufacturing the same are described in detail hereunder.

A first steel of this invention comprises, by weight, not more than 0.03% carbon, not more than 2.00 silicon, not more than 5.0% manganese, not more than 0.030% sulfur, 16–20% chromium, 6–13% nickel, 0.15–0.28% nitrogen, 0.05–0.25% niobium, not more than 0.0020% boron, and iron and other impure elements constituting the rest.

The corrosion resistance of the first steel is improved by adding at least one of either not more than 4% molybdenum or not more than 4% copper to the first steel or decreasing the sulfur content to not more than 0.005% so as to make a second steel of this invention. Further the machinability of the first steel is improved by adding at least one of 0.030–0.080% sulfur or 0.005–0.080% selenium to the first steel so as to make a third steel of this invention.

The strength of the first, second and third steels are enhanced by heating these steels to 950°–1,300° C. and then rolling them at temperatures of 900°–1,250° C. The temperature of the finish rolling for these steels are controlled at 900°–1,000° C. Then these steels are cooled at rates exceeding 4° C./min in order to make fourth, seventh, and ninth steels of this invention, the structures of which are recrystallized microstructure, and the yield strength of which, respectively, exceeds 50 kg/mm$^2$. The total forming ratio of these steels respectively exceeds 30%.

The first, second and third steels are heated at temperatures of 950°–1,300° C., and then rolled at temperatures of 600°–1,250° C. The temperatures of the finish rolling for these steels are controlled to be 600°–900° C. Then these steels are cooled at rates exceeding 4 ° C./min so as to make fifth, eighth and tenth steels. The total forming ratio of these steels respectively exceeds 30%. The structures of these steels are unrecrystallized microstructures. And, the yield strength of these steels respectively, exceeds 60 kg/mm$^2$.

The strength of the first steel is enhanced by heating at temperatures of 950°–1,300° C. and then rolling at temperatures of 900°–1,250° C. in order to manufacture a sixth steel of this invention. The temperature of the finish rolling for this steel is controlled at lower than 1,000° C. Then a low temperature solution heat treatment is provided to this steel at temperatures of 900°–1010° C. The JIS G 0551 crystal grain number of this steel exceeds 7.5, and the yield strength of this steel is more than 40 kg/mm$^2$.

The reasons for limiting the composition of these steels are explained hereunder.

Carbon, an element to beware of in the steels of this invention, diminishes the corrosion resistance and the hot workability during control rolling unless the carbon content in these steels is limited to not more than 0.03%. Therefore, the maximum content of carbon is determined to be 0.03%.

Silicon is an element added to these steels as a deoxidizer and to improve the strength of these steels. Silicon, however, causes high-temperature cracks to occur during welding and diminishing the quantity of nitrogen in the solid solution during solidification of these steels unless the silicon content is kept at not more than 2.0%. Therefore, the maximum content of silicon is determined to be 2.0%.

Manganese is added to these steels as a deoxidizer and for increasing the solubility of nitrogen. Manganese, however, diminishes the corrosion resistance and hot workability of these steels when it is contained in a large quantity. Thus, the maximum content of manganese is determined to be 5.0%.

Chromium is a primary element of stainless steels. The chromium content should equal or exceed 16% to produce superior corrosion resistance. Chromium, however, causes imbalance of $\delta/\gamma$ structures when it is contained in a large quantity. Therefore, the maximum content of chromium is limited to 20%.

Nickel is a primary element of austenitic stainless steels. The nickel content should equal or exceed 6% to provide stainless steels with a superior corrosion resistance and austenitic structure. Nickel, however, causes cracks to occur during welding and diminishes of hot workability and corrosion resistance (after control rolling) when it is contained in a large quantity. Therefore, the maximum content of nickel is limited to 13%.

Nitrogen is the principal reinforcing element of the steels of this invention. Nitrogen provides the effects of penetration-type solubility reinforcement, refining of crystal grains and precipitation hardening by precipitation of Nb(C, N). Nitrogen also contributes to improvement of the corrosion resistance after control rolling. And, the nitrogen content should equal or exceed 0.15% to produce these effects. Therefore, the minimum content of nitrogen is limited at 0.15%. Nitrogen, however, decreases hot workability and causes blowholes to occur during the solidification and welding when it is contained in a large quantity. Thus, the maximum content of nitrogen is limited at 0.28%.

Niobium is one of the primary elements of the steels of this invention. Niobium fixes remaining carbon as NbC, improves corrosion resistance after control rolling, refines the crystal grains by the precipitation of Nb(C,N), and reinforces the strength of these steels after control rolling. The niobium content should equal to or exceed 0.05% to produce these effects. Niobium, however, is an expensive element, and it also diminishes the hot workability of these steels when more than the required amount is present. Therefore, the maximum content of niobium is limited at 0.25%.

The Boron content should be limited to a minimum because boron diminishes the intergranular corrosion resistance and the corrosion resistance after control rolling. Therefore, the maximum content of boron is limited to 0.0020% and more preferably to 0.0005%.

Molybdenum and copper further improve the corrosion resistance of the steels of this invention. Molybdenum and copper, however, are expensive elements and they diminish the hot workability when the molybdenum and copper contents exceed 4%. Therefore, the maximum contents of molybdenum and copper are limited, respectively at 4%.

The corrosion resistance is enhanced when sulfur is contained minimally. The ductility and toughness (especially in the direction of 90° angle in relation to the direction of the rolling) of these steels after control rolling is also improved by minimizing sulfur. Therefore, the sulfur content should be limited at least to not more than 0.005%, and more preferably to not more than 0.001%.

Sulfur and selenium enhance the machinability of the steels of this invention. Sulfur should be present in an amount of more than 0.030%, and the selenium content should equal or exceed 0.005%. Both sulfur and selenium, however, diminish the hot workability and corrosion resistance when they constitute more than 0.080%, respectively. Therefore, the maximum content of sulfur and selenium are limited respectively at 0.080%.

The heating temperatures are limited at 950°-1,300° C. during control rolling in order to decrease the distortion resistance. Rolling becomes difficult at temperatures not less than 950 ° C. due to a large distortion resistance. And, the rolling also becomes difficult at temperatures exceeding 1,300° C. because the grain boundary will melt partially or crystal grains become large.

The temperatures for the finish rolling is limited at 900°-1,000° C. to control the strength of the steels of this invention. The strength of these steels improves as the temperature decreases within the range of 900°-1,000° C. A sufficient strength of these steels, cannot be obtained when the temperatures exceed 1,000° C., because recrystallized grains become large. The ductility and toughness of these steels in the direction of 90° angle in relation to the direction of the rolling decrease when the temperatures are lower than 900° C. because the recrystallized microstructures cannot be produced in this temperature range. That is to say, the recrystallized microstructures with high strength and corrosion resistance, which are superior in ductility and toughness in the direction of the rolling and the direction crossing the rolling direction at 90° angle, can be obtained at the finish rolling temperature range of 900°-1,000° C.

Further, the temperature for the finish rolling is limited to 600°-900 ° C. because the recrystallized microstructures cannot be made at temperatures not more than 900° C. and the strength of the steels is enhanced as the finish rolling temperature decreases. The ductility and toughness of the steels will diminish as the finish rolling temperature decreases. Therefore, it is preferable to keep sulfur at not more than 0.005% when the rolling is provided at temperatures of 600°-900° C.

In addition, the rolling becomes difficult at temperatures lower than 600° C. The distortion resistance increases sharply during the rolling at temperatures lower than 600° C. because the temperatures are lower than the recovery temperature of the steels of this invention.

The low temperature solution heat treatment is provided at temperatures of 900°-1,010° C. because carbon can remain in the form of a solid solution in the steels of this invention at this temperature range and the crystallized grains become finer and stronger as the temperature of heat treatment becomes closer to 900° C.

Carbon does not become a solid solution or recrystallize at temperatures lower than 900° C. And, the size numbers of the crystal grains become not more than 7.5 and the strength of these steels decreases when the temperatures exceed 1,010° C.

The cooling rates after rolling should exceed 4° C./min. $Cr_{23}C_6$ or $Cr_2N$ precipitates in the grain boundary and diminishes the corrosion resistance of these steels when the cooling rates are lower than 4° C./min. The total forming ratio of the steels at rolling temperatures of 900°-1,250° C. should equal or exceed 30%. The desired structure cannot be obtained unless the total forming ratio equals or exceeds 30% because little lattice defect and accumulated energy, which are introduced in the crystal by the forming, will remain in the unrefined structures made during heating.

DESCRIPTION OF THE PREFERRED EMBODIMENTS

The features of the steels of this invention are described hereunder by comparing conventional steels, comparative examples and embodiments of this invention.

Table 1 shows the chemical composition of the sample steels.

In table 1, steels A-G are conventional steels, of which steel A is SUS304, steel B is SUS316, steel C is SUS304L, steel D is SUS316L, steel E is $SUS304N_1$, steel F is $SUS304N_2$, and steel G is SUS316N. Steels H-Q are the steels of this invention, of which steels H-K are first steels of this invention, steels L-N are second steels of this invention and steels P and Q are third steels of this invention.

Table 2 indicates the strength, corrosion resistance and hot-workability of steels A-Q which have been processed with solution heat treatment (1,050° C.×30 min.→W,Q.).

TABLE 1

| | CHEMICAL COMPOSITION (WEIGHT %) | | | | | | | | | | | |
|---|---|---|---|---|---|---|---|---|---|---|---|---|
| | C | Si | Mn | S | Ni | Cr | N | Nb | B | Mo | Cu | Se |
| A | 0.07 | 0.68 | 1.23 | 0.011 | 8.87 | 18.74 | 0.02 | | | | | |
| B | 0.06 | 0.62 | 1.15 | 0.010 | 12.48 | 17.69 | 0.02 | | | 2.12 | | |
| C | 0.02 | 0.59 | 1.27 | 0.013 | 10.27 | 18.50 | 0.02 | | | | | |
| D | 0.02 | 0.56 | 1.04 | 0.010 | 13.52 | 17.95 | 0.02 | | | 2.25 | | |
| E | 0.06 | 0.63 | 1.20 | .0.011 | 8.55 | 18.56 | 0.22 | | | | | |
| F | 0.06 | 0.66 | 1.17 | 0.011 | 8.69 | 18.73 | 0.20 | 0.10 | | | | |
| G | 0.07 | 0.64 | 1.28 | 0.012 | 12.73 | 17.39 | 0.17 | | | 2.13 | | |
| H | 0.02 | 0.57 | 1.23 | 0.010 | 6.92 | 18.63 | 0.18 | 0.10 | 0.0008 | | | |
| J | 0.02 | 0.54 | 2.20 | 0.006 | 9.11 | 18.27 | 0.21 | 0.09 | 0.0005 | | | |
| K | 0.03 | 0.65 | 2.58 | 0.007 | 8.23 | 18.52 | 0.25 | 0.18 | 0.0002 | | | |
| L | 0.02 | 0.63 | 2.36 | 0.001 | 8.06 | 18.36 | 0.22 | 0.13 | 0.0003 | | | |
| M | 0.01 | 0.67 | 2.29 | 0.001 | 7.59 | 18.76 | 0.21 | 0.12 | 0.0002 | 2.57 | | |
| N | 0.02 | 0.61 | 1.17 | 0.008 | 7.75 | 18.12 | 0.18 | 0.10 | 0.0005 | | 1.89 | |
| P | 0.02 | 0.64 | 2.23 | 0.052 | 7.92 | 18.71 | 0.17 | 0.08 | 0.0007 | | | |
| Q | 0.02 | 0.57 | 1.89 | 0.012 | 8.13 | 19.52 | 0.16 | 0.08 | 0.0005 | | | 0.037 |

TABLE 2

| | 0.2% YIELD STRENGTH (kg/mm²) | INTER-GRANULAR CORROSION RESISTANCE | STRESS CORROSION CRACKING SUSCEPTIBILITY RESISTANCE | HOT WORKABILITY CONTRACTION (%) | PITTING CORROSION POTENTIAL OF WELDING HEAT-AFFECTED AREA (VvsSCE) | PITTING CORROSION POTENTIAL OF BASE METAL (VvsSCE) |
|---|---|---|---|---|---|---|
| A | 25.0 | X | X | 82 | 0.12 | 0.27 |
| B | 25.2 | X | X | 72 | 0.31 | 0.46 |
| C | 22.8 | Δ | X | 85 | 0.25 | 0.28 |
| D | 23.4 | Δ | O | 75 | 0.45 | 0.48 |
| E | 32.1 | X | X | 64 | 0.22 | 0.36 |
| F | 40.7 | X | X | 62 | 0.27 | 0.37 |
| G | 39.2 | X | X | 60 | 0.39 | 0.54 |
| H | 48.7 | O | O | 80 | 0.37 | 0.37 |
| J | 50.1 | O | O | 79 | 0.39 | 0.38 |
| K | 51.9 | O | O | 76 | 0.34 | 0.35 |
| L | 49.7 | O | O | 82 | 0.40 | 0.40 |
| M | 49.0 | O | O | 77 | 0.55 | 0.56 |
| N | 49.7 | O | O | 74 | 0.41 | 0.40 |
| P | 48.1 | O | O | 70 | 0.31 | 0.32 |
| Q | 48.2 | O | O | 72 | 0.33 | 0.34 |

The column of yield resistance indicates the yield resistance of steels A–Q which has been measured with the No. 4 test pieces of Japanese Industrial Standard.

The intergranular corrosion resistance of these steels has been measured after sensitization treatment was provided at a temperature of 800° C. for 2 hours. In the column of intergranular corrosion resistance, O indicates step structure, Δ indicates dual structure and X indicates ditch structure.

Stress corrosion cracking susceptibility resistance of these steels has been measured in a manner that the occurrence of cracking in these steels was checked after the test pieces which were bent in U shape were immersed in a boiling aqueous solution of 20% NaCl+1% $Na_3Cr_2O_7$ for 50 hours. In the column of stress corrosion cracking susceptibility resistance, O indicates non-occurrence of cracks and X indicates an occurrence of cracks.

As for the hot workability, a high temperature tensile test was conducted at a rate of 50 mm/second at a temperature of 850 ° C. to measure contraction percentage of these steels.

As for the corrosion resistance of base metals and the area affected by welding heat, pitting corrosion potentials have been measured in an aqueous solution of 3.5% NaCl at 30° C.

As shown in Table 2, the conventional steels A and C are superior in hot workability, whereas their yield resistance of 25.0 kg/mm² and 22.8 kg/mm² is low. Steels A and C are also inferior in intergranular corrosion resistance, stress corrosion cracking susceptibility resistance and corrosion resistance of base metals and welding heat-affected areas.

The conventional steel B is superior in hot workability and corrosion resistance of base metals and welding heat-affected areas, whereas its yield resistance of 25.2 kg/mm² is low. Steel B is also inferior in intergranular corrosion resistance and stress corrosion cracking susceptibility resistance.

Conventional steel D is superior in stress corrosion cracking susceptibility resistance, hot workability and corrosion resistance of base metals and welding heat-affected areas, whereas its yield resistance of 23.4 kg/mm² is low; Steel D is also inferior in intergranular corrosion resistance.

Conventional steel E possesses a yield resistance of 32.1 kg/mm², which is much higher than that of steel A because 0.22% nitrogen is added to steel A to make steel E. Yet, the yield resistance of steel E still cannot meet the strength required of a high-strength stainless steel.

Conventional steel F possesses a yield resistance of 40.7 kg/mm², which is even higher than that of steel E because 0.10% niobium is added to steel E to make steel F; this meets the strength required of a high-strength stainless steel. The hot workability of steel F, however, is low.

The Conventional steel G possesses a superior yield resistance of 39.2 kg/mm², which is even higher than that of steel B because 0.17% nitrogen is added to steel B to make steel G. The hot workability is lower than that of steel B (like steel F), and intergranular corrosion resistance and stress corrosion cracking susceptibility resistance of steel G are lower than those of steel B.

As opposed to these conventional steels;

Steels H–Q of the present invention possess yield strengths exceeding 48 kg/mm² and step structure for intergranular corrosion resistance. As for the stress corrosion cracking susceptibility resistance, no cracks occurred in any of steels H–Q even after 50 hours of immersion test. As for hot workability, which is not diminished as for conventional steels, each of steels H–Q showed a contraction percentage not less than 70%. Steels H–Q are also superior in corrosion resistance of base metals and welding heat-affected areas with pitting corrosion potentials exceeding 0.3 V.

TABLE 3

| | FINISH ROLLING TEMPERATURE (950° C.) | | FINISH ROLLING TEMPERATURE (800° C.) | | FINISH ROLLING TEMPERATURE (950° C.) LOW TEMPERATURE SOLUTION HEAT TREATMENT (980° C. × 30 min.) | | |
|---|---|---|---|---|---|---|---|
| | 0.2% YIELD STRENGTH (kg/mm²) | PITTING CORROSION POTENTIAL (VvsSCE) | 0.2% YIELD STRENGTH (kg/mm²) | PITTING CORROSION POTENTIAL (VvsSCE) | 0.2% YIELD STRENGTH (kg/mm²) | PITTING CORROSION POTENTIAL (VvsSCE) | CRYSTAL GRAIN SIZE NUMER |
| A | 33 | 0.15 | 42 | 0.12 | 30 | 0.18 | 5.0 |
| C | 25 | 0.24 | 31 | 0.23 | 24 | 0.27 | 4.8 |
| E | 44 | 0.16 | 53 | 0.12 | 40 | 0.20 | 5.2 |

TABLE 3-continued

| | FINISH ROLLING TEMPERATURE (950° C.) | | FINISH ROLLING TEMPERATURE (800° C.) | | FINISH ROLLING TEMPERATURE (950° C.) LOW TEMPERATURE SOLUTION HEAT TREATMENT (980° C. × 30 min.) | | |
|---|---|---|---|---|---|---|---|
| | 0.2% YIELD STRENGTH (kg/mm²) | PITTING CORROSION POTENTIAL (VvsSCE) | 0.2% YIELD STRENGTH (kg/mm²) | PITTING CORROSION POTENTIAL (VvsSCE) | 0.2% YIELD STRENGTH (kg/mm²) | PITTING CORROSION POTENTIAL (VvsSCE) | CRYSTAL GRAIN SIZE NUMER |
| F | 65 | 0.18 | 77 | 0.16 | 50 | 0.22 | 7.2 |
| J | 66 | 0.37 | 77 | 0.36 | 51 | 0.37 | 7.8 |
| M | 67 | 0.54 | 78 | 0.55 | 52 | 0.55 | 7.7 |
| P | 65 | 0.32 | 77 | 0.32 | — | — | — |

These properties of steels H–Q are produced by simultaneously adding 0.15–0.28% nitrogen and 0.05–0.25% niobium, limiting carbon to no more than 0.03% and limiting boron to not more than 20 ppm. Steels H–Q of this invention are superior in strength, intergranular corrosion resistance, stress corrosion cracking susceptibility resistance, hot workability and corrosion resistance of base metals and welding heat-affected areas.

Table 3 indicates the strength and corrosion resistance of steels A, C, E, F, J, M and P, and the JIS G 0551 crystal grain size numbers of those to which a low-temperature solution heat treatment was applied. 10×40 mm sheet steels of steels A, C, E, F, J, M, and P were rolled after they had been heated to a temperature of 1,150° C. The temperatures of finish rolling for these steels were controlled at approximately 950° C. or approximately 800° C. Then, these steels were cooled at a rate of 50° C./min. And, the total forming ratio of these steels was controlled to 96%. In addition, a low temperature solution heat treatment was applied to another group of these steels at a temperature of 980° C. for 30 minutes after they had been finish rolled at a temperature of 950° C. and then cooled at a rate of 50° C./min. The total forming ratio of this group of steels was also controlled to 96%.

As can be seen in Table 3, when the temperatures of finish rolling are controlled at temperatures of 950° C. or 800° C., the yield resistance of steel A improves from 25 kg/mm² to 33 kg/mm² or 42 kg/mm², the yield resistance of steel C improves from 22.8 kg/mm² to 25 kg/mm² or 31 kg/mm², and the yield resistance of steel E improves from 32.1 kg/mm² to 44 kg/mm² or 53 kg/mm². The desired yield resistance of 50 kg/mm² or 60 kg/mm², however, cannot be obtained by steel A, C, or E. Further, the corrosion resistance of steels A, C, and E decreases sharply due to control rolling.

The yield resistance of steel F improves by control rolling from 40.7 kg/mm² to 65 kg/mm² or 77 kg/mm², whereas the corrosion resistance of steel F decreases sharply from 0.37 V to 0.18 V and 0.16 V.

As opposed to these conventional steels, the yield resistance of steels J, M and P of the present invention improves significantly from about 50 kg/mm² to about 65 kg/mm² because recrystallized microstructures are formed when the temperature for finish rolling is controlled to 950° C. Further the yield resistance of steels J, M and P improves even more to about 77 kg/mm² when the temperature for finish rolling is controlled to 800° C. due to unrecrystallized processed structures made thereby. Thus, it is obvious from the above that the yield resistance of the steels of this invention improves significantly by control rolling.

As for corrosion resistance, the pitting corrosion potentials of steels J, M and P do not change even after control rolling is provided. Unlike conventional steels, the corrosion resistance of steels of this invention does not decline after control rolling is provided.

Further, when a finish rolling temperature of 950° C., cooling rate of 50° C./min and then a low temperature solution heat treatment of 980° C. for 30 minutes are provided to the sample steels, the yield resistance of conventional steels A, C and E improves a little, but does not improve sufficiently to the desired level, and the corrosion resistance of these steels decreases in the same manner as set forth above. The yield resistance of steel F improves up to 50 kg/mm² by control rolling and low temperature solution heat treatment, whereas the corrosion resistance of steel F decreases in the same manner as set forth above.

As opposed to these conventional steels, steels J, M and P of this invention do not diminish their corrosion resistance after control rolling and low temperature solution heat treatment. Steels J, M and P possess recrystallized microstructures for which crystal JIS G 0551 grain size numbers exceed 7.5. The respective yield resistance of steels J, M, and P has improved to more than 50 kg/mm², and the pitting corrosion potentials are about the same as those of solution heat-treated steels (1,050° C.×30 min→W, Q).

The strength and the corrosion resistance of the steels of this invention are enhanced by inhibiting boron, an impurity element, and decreasing the carbon content of an austenitic stainless steel. And, the strength of steels is further enhanced without diminishing the corrosion resistance by providing such heat treatment as control rolling and low temperature solution heat treatment after the steels are processed by control rolling. Therefore, the steels of this invention are fit for reinforcement members employed in construction of such plants as chemical, sea water and nuclear plants, and can be expected to make a large industrial contribution.

We claim:

1. A high-strength hot-worked stainless steel comprising carbon and boron, and having as essential limitations, by weight, not more than 0.03% carbon, not more than 2.00% silicon, not more than 5.0% manganese, at least one member selected from the group consisting of copper (not more than 4.0%), sulfur (not more than 0.08%) and selenium (not more than 0.08%), from 6 to 13% nickel, from 16 to 20% chromium, from 0.15 to 0.28% nitrogen, from 0.05 to 0.25% niobium, not more than 0.0020% boron, and iron; the stainless steel being a member selected from the group consisting of (a) stainless steel having a JIS G 0551 crystal grain size number of more than 7.5 and a yield strength of at least 35 kg/mm², (b) stainless steel having a recrystallized microstructure and a yield strength of at least 50 kg/mm² and (c) stainless steel having a roll-processed structure and a yield strength of at least 60 kg/mm².

2. A stainless steel according to claim 1 and consisting essentially of carbon, silicon, from 2.2 to 50% by weight of manganese, not more than 0.030% sulfur, nickel, chromium, nitrogen, niobium, boron and iron.

3. A stainless steel according to claim 1 and consisting essentially of carbon, silicon, from 2.2 to 5.0% by weight of manganese, nickel, chromium, nitrogen, niobium, boron, at least one member selected from the group consisting of copper and sulfur (not more than 0.005% by weight), and iron.

4. A stainless steel according to claim 1 and consisting essentially of carbon, silicon, from 2.2 to 5.0% by weight of manganese, nickel, chromium, nitrogen, niobium, boron, at least one member selected from the group consisting of sulfur (from 0.030 to 0.080% by weight) and selenium (from 0.005 to 0.080% by weight), and iron.

5. A stainless steel according to claim 1 and consisting essentially of carbon, silicon, manganese, not more than 0.030% by weight of sulfur, nickel, chromium, nitrogen, niobium, boron and iron.

6. A stainless steel according to claim 1 and consisting essentially of carbon, silicon, manganese, nickel, chromium, nitrogen, niobium, boron, at least one member selected from the group consisting of copper and sulfur (not more than 0.005% by weight), and iron.

7. A stainless steel according to claim 1 and consisting essentially of carbon, silicon, manganese, nickel, chromium, nitrogen, niobium, boron, at least one member selected from the group consisting of sulfur (from 0.030 to 0.080% by weight) and selenium (from 0.005 to 0.080% by weight), and iron.

8. A high-strength stainless steel according to claim 1 and consisting essentially of carbon, silicon, manganese (from 2.2 to 5.0% by weight), sulfur (not more than 0.030% by weight), nickel, chromium, nitrogen, niobium, boron (not more than 0.0020% by weight), and iron, the metallographical structure of the stainless steel being a recrystallized microstructure, and the stainless steel having a yield strength of not less than 50 kg/mm$^2$.

9. A high strength stainless steel according to claim 1 and consisting essentially of carbon, silicon, manganese (from 2.2 to 5.0% by weight), sulfur (not more than 0.030% by weight), nickel, chromium, nitrogen, niobium, boron, and iron, the stainless steel having a roll-processed structure and a yield strength of not less than 60 kg/mm$^2$.

10. A high-strength stainless steel according to claim 1 and consisting essentially of carbon, silicon, manganese (from 2.2 to 5.0% by weight) sulfur (not more than 0.030% by weight), nickel, chromium, nitrogen, niobium, boron and iron, the stainless steel having a JIS G 0551 crystal grain size of more than 7.5 and a yield strength of not less than 40 kg/mm$^2$.

11. A high-strength hot-worked stainless steel according to claim 1, which has a JIS G 0551 crystal grain size number of more than 7.5 and a yield strength of at least 40 kg/mm$^2$.

12. A high-strength hot-worked stainless steel according to claim 1, which has a recrystallized microstructure and a yield strength of at least 50 kg/mm$^2$.

13. A high-strength hot-worked stainless steel according to claim 1, which has a roll-processed structure and a yield strength of at least 60 kg/mm$^2$.

14. A high-strength, hot worked stainless steel according to claim 1, comprising by weight, not more than 0.03% carbon, not more than 0.80% silicon, not more than 3.0% manganese, not more than 0.015% sulfur, 6–13% nickel, 16–20% chromium, 0.15–0.28% nitrogen, 0.05–0.25% niobium, not more than 0.0008% boron, the remainder being iron together with impurities.

15. A high-strength, hot worked stainless steel according to claim 1, comprising, by weight, not more than 0.03% carbon, not more than 0.80% silicon, not more than 3.0% manganese, not more than 0.015% sulfur, 7–9.5% nickel, 17–20% chromium, 0.15–0.28% nitrogen, 0.05–0.15% niobium, not more than 0.0008% boron, the remainder being iron together with impurities.

16. A high-strength, hot worked stainless steel according to claim 3, comprising by weight, not more than 0.03% carbon, not more than 0.80% silicon, not more than 3.0% manganese, 6–13% nickel, 16–20% chromium, 0.15–0.28% nitrogen, 0.05–0.25% niobium, not more than 0.0020% boron, not more than 0.005% sulfur, the remainder being iron together with impurities.

17. A high-strength, hot worked stainless steel according to claim 3, comprising by weight, not more than 0.03% carbon, not more than 0.80% silicon, not more than 3.0% manganese, 6–13% nickel, 16–20% chromium, 0.15–0.28% nitrogen, 0.05–0.25% niobium, not more than 0.0020% boron, at least one or more selected from the group consisting of not more than 3.0% copper and not more than 0.005% sulfur, the remainder being iron together with impurities.

18. A high-strength, hot worked stainless steel according to claim 3, comprising by weight, not more than 0.03% carbon, not more than 0.80% silicon, not more than 3.0% manganese, 6–13% nickel, 16–20% chromium, 0.15–0.28% nitrogen, 0.05–0.25% niobium, not more than 0.0020% boron, at least one or more selected from the group consisting of not more than 2.0% molybdenum and not more than 0.005% sulfur, the remainder being iron together with impurities.

19. A high-strength, hot worked stainless steel according to claim 4, comprising by weight, not more than 0.03% carbon, not more than 0.80% silicon, not more than 3.0% manganese, 6–13% nickel, 16–20% chromium, 0.15–0.28% nitrogen, 0.05–0.25% niobium, not more than 0.0020% boron, 0.035–0.080% sulfur, the remainder being iron together with impurities.

20. A high-strength, hot worked stainless steel according to claim 4, comprising by weight, not more than 0.03% carbon, not more than 0.80% silicon, not more than 3.0% manganese, 6–13% nickel, 16–20% chromium, 0.15–0.28% nitrogen, 0.05–0.25% niobium, not more than 0.0020% boron, 0.005–0.080% selenium, the remainder being iron together with impurities.

21. In a process for producing stainless steel reinforcement members for chemical plants, sea water plants or nuclear plants, the improvement wherein the stainless steel is a high-strength, hot worked stainless steel according to claim 1.

22. A high-strength stainless steel according to claim 1 which has the following properties:

an intergranular corrosion resistance exceeding that of SUS304L, strength comparable to that of control-rolled SUS304N$_2$, corrosion resistance comparable to steel subjected to solution heat treatment, a yield strength exceeding 40 kg/mm$^2$, superior stress-corrosion-cracking-susceptibility resistance, higher pitting corrosion resistance than that of SUS304, higher acid resistance than that of SUS304, retains corrosion resistance after welding, and possesses hot-workability.

* * * * *